US010049638B2

(12) United States Patent
Lin

(10) Patent No.: US 10,049,638 B2
(45) Date of Patent: Aug. 14, 2018

(54) DEMULTIPLEX TYPE DISPLAY DRIVING CIRCUIT

(71) Applicant: Wuhan China Star Optoelectronics Technology Co., Ltd., Wuhan (CN)

(72) Inventor: Jianhong Lin, Wuhan (CN)

(73) Assignee: WUHAN CHINA STAR OPTOELECTRONICS TECHNOLOGY CO., LTD., Wuhan, Hubei (CN)

( * ) Notice: Subject to any disclaimer, the term of this patent is extended or adjusted under 35 U.S.C. 154(b) by 223 days.

(21) Appl. No.: 15/026,596

(22) PCT Filed: Feb. 24, 2016

(86) PCT No.: PCT/CN2016/074466
§ 371 (c)(1),
(2) Date: Mar. 31, 2016

(87) PCT Pub. No.: WO2017/117847
PCT Pub. Date: Jul. 13, 2017

(65) Prior Publication Data

US 2018/0047353 A1 Feb. 15, 2018

(30) Foreign Application Priority Data

Jan. 4, 2016 (CN) ..... 2016 1 0003066

(51) Int. Cl.
*G09G 3/36* (2006.01)

(52) U.S. Cl.
CPC ..... *G09G 3/3688* (2013.01); *G09G 3/3607* (2013.01); *G09G 3/3614* (2013.01); *G09G 3/3648* (2013.01); *G09G 2310/0297* (2013.01)

(58) Field of Classification Search
CPC ..... G09G 2310/0297; G09G 3/3614; G09G 3/3688
See application file for complete search history.

(56) References Cited

U.S. PATENT DOCUMENTS

2004/0046725 A1* 3/2004 Lee ..... G09G 3/3607 345/88
2006/0119559 A1* 6/2006 Jung ..... G09G 3/3614 345/96
2007/0040764 A1* 2/2007 Kim ..... G09G 3/3291 345/30

(Continued)

*Primary Examiner* — Sanjiv D Patel
(74) *Attorney, Agent, or Firm* — Leong C. Lei

(57) ABSTRACT

Disclosed is a demultiplex type display driving circuit, applied in a RGBW four colors pixel structure display device, comprising a plurality of driving units, and each driving unit comprises eight demultiplex modules, and each demultiplex module comprises three thin film transistors, and gates of the three thin film transistors are electrically coupled to a first branch control signal (Demux1), a second branch control signal (Demux2), and a third branch control signal (Demux3) respectively, and source are electrically coupled to the same data signal, and drains are electrically coupled to one data line in a jump manner, respectively. Thus, the pulse duration of each branch control signal is equal to ⅓ of a pulse duration of the scan signal to increase the charging time of the data signal and promote the charging rate of the sub pixel under circumstance that the pulse duration of the scan signal is not changed.

15 Claims, 4 Drawing Sheets

(56) References Cited

U.S. PATENT DOCUMENTS

| | | | | |
|---|---|---|---|---|
| 2008/0278466 | A1* | 11/2008 | Joo | G09G 3/3614 345/205 |
| 2011/0249046 | A1* | 10/2011 | Lee | G09G 3/3688 345/691 |
| 2011/0299023 | A1* | 12/2011 | Lee | G02F 1/1368 349/143 |
| 2014/0184583 | A1* | 7/2014 | Wyatt | G09G 3/3614 345/214 |
| 2016/0322008 | A1* | 11/2016 | Sang | G09G 3/3275 |

* cited by examiner

DEMULTIPLEX TYPE DISPLAY DRIVING CIRCUIT

FIELD OF THE INVENTION

The present invention relates to a display technology field, and more particularly to a demultiplex type display driving circuit.

BACKGROUND OF THE INVENTION

The panel display device, such as the Liquid Crystal Display (LCD) and the Organic Light Emitting Display (OLED) comprises a plurality of pixels aligned in array. Each pixel generally comprises sub pixels of red, green, blue, three colors. Each sub pixel is controlled by one gate line and one data line. The gate line is employed to control the on and off of the sub pixel, and the data line applies various data voltage signals to make the sub pixel show various gray scales, and thus for realizing the full color image display.

With the development of the display technology, the requirements of the people to the display qualities of the display device, such as the display brightness, the color reduction, the richness of the image color gets higher and higher. The display merely utilizing the red, green and blue, three primary colors can no longer satisfy the requirements of the people to the display device. Thereafter, the four colors display device having red, green, blue, white four colors is proposed. One white sub pixel is added in each pixel for forming the RGBW pixel structure constructed by the red sub pixel R, the green sub pixel G, the blue sub pixel B and the white sub pixel W. In the same display image, the display device utilizing the RGBW pixel structure has the larger pixel pitch than the display device utilizing the RGB three colors sub pixels structure, and the added white sub pixel has high transmission rate. The RGBW four colors sub pixels structure display device has benefits of high transmission rate and high aperture ratio, and is pursued by the consumers.

FIG. 1 shows a demultiplex type display driving circuit used in a RGBW four colors pixel structure display device according to prior art, comprising: a plurality of driving units, and each driving unit comprises: eight data lines D1-D8, which are mutually parallel, sequentially aligned and vertical, at least two scan lines Gn (n is a positive integer), which are mutually parallel, sequentially aligned and horizontal, sub pixels 100 of at least two rows-eight columns, and sixteen in total, which are aligned in array, and first and second demultiplex modules De10, De20; each sub pixel 100 is electrically coupled to the scan line corresponded with the row where the sub pixel 100 is and the data line corresponded with the column where the sub pixel 100 is; each demultiplex module comprises four thin film transistors, and gates of the four thin film transistors are electrically coupled to a first branch control signal Demux1, a second branch control signal Demux2, a third branch control signal Demux3 and a fourth branch control signal Demux4 respectively, and sources are all electrically coupled to the same data signal, and sources are electrically coupled to one data line, respectively. Specifically, the first demultiplex module De10 comprises: a first thin film transistor T10, and a gate of the first thin film transistor T10 is electrically coupled to the first branch control signal Demux1, and a source is electrically coupled to a first data signal Data10, and a drain is electrically coupled to a first data line D1; a second thin film transistor T20, and a gate of the second thin film transistor T20 is electrically coupled to the second branch control signal Demux2, and a source is electrically coupled to the first data signal Data10, and a drain is electrically coupled to a sixth data line D6; and a third thin film transistor T30, and a gate of the third thin film transistor T30 is electrically coupled to the third branch control signal Demux3, and a source is electrically coupled to a first data signal Data10, and a drain is electrically coupled to a seventh data line D7; a fourth thin film transistor T40, and a gate of the fourth thin film transistor T40 is electrically coupled to the fourth branch control signal Demux4, and a source is electrically coupled to the first data signal Data10, and a drain is electrically coupled to a fourth data line D4; the second demultiplex module De20 comprises: a fifth thin film transistor T50, and a gate of the fifth thin film transistor T50 is electrically coupled to the first branch control signal Demux1, and a source is electrically coupled to the second data signal Data20, and a drain is electrically coupled to a fifth data line D5; and a sixth thin film transistor T60, and a gate of the sixth thin film transistor T60 is electrically coupled to the second branch control signal Demux2, and a source is electrically coupled to a second data signal Data20, and a drain is electrically coupled to a second data line D2; a seventh thin film transistor T70, and a gate of the seventh thin film transistor T70 is electrically coupled to the third branch control signal Demux3, and a source is electrically coupled to a second data signal Data20, and a drain is electrically coupled to a third data line D3; an eighth thin film transistor T80, and a gate of the eighth thin film transistor T80 is electrically coupled to the fourth branch control signal Demux4, and a source is electrically coupled to the second data signal Data20, and a drain is electrically coupled to an eighth data line D8. The first data signal Data10 have a positive polarity, and the second data signal Data2 have a negative polarity, and the gate line Gn receives the scan signal Gate, and pulse durations of the first, second, third and fourth branch control signals Demux1, Demux2, Demux3, Demux4 are ¼ of a pulse duration of the scan signal Gate.

Please refer to FIG. 2. With the constantly increase of the resolution of the display device, the pulse duration of the scan signal Gate also has been constantly shortened. The pulse durations of the first, second, third and fourth branch control signals Demux1, Demux2, Demux3, Demux4 are constantly compressed. Then, the data switch time arranged for the sub pixels of each column is shortened, too. Consequently, the charging rate of the sub pixel is insufficient, and the data signal entering the sub pixel cannot reach the voltage level.

SUMMARY OF THE INVENTION

An objective of the present invention is to provide a demultiplex type display driving circuit, which is applied for the display device of high resolution, and can increase the charging time of the data signal and promote the charging rate of the sub pixel under circumstance that the pulse duration of the scan signal is not changed.

For realizing the aforesaid objective, the present invention provides a demultiplex type display driving circuit, comprising: a plurality of driving units, and each driving unit comprises: twenty-four data lines, which are mutually parallel, sequentially aligned and vertical, at least two scan lines, which are mutually parallel, sequentially aligned and horizontal, sub pixels of at least two rows-twenty-four columns, and forty-eight in total, which are aligned in array, and eight demultiplex modules;

each sub pixel is electrically coupled to the scan line corresponded with the row where the sub pixel is and the data line corresponded with the column where the sub pixel is;

each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line, respectively;

the first demultiplex module comprises: a first thin film transistor, and a gate of the first thin film transistor is electrically coupled to the first branch control signal, and a source is electrically coupled to a first data signal, and a drain is electrically coupled to a first data line; a second thin film transistor, and a gate of the second thin film transistor is electrically coupled to the second branch control signal, and a source is electrically coupled to the first data signal, and a drain is electrically coupled to a fourth data line; and a third thin film transistor, and a gate of the third thin film transistor is electrically coupled to the third branch control signal, and a source is electrically coupled to a first data signal, and a drain is electrically coupled to a sixth data line;

the second demultiplex module comprises: a fourth thin film transistor, and a gate of the fourth thin film transistor is electrically coupled to the first branch control signal, and a source is electrically coupled to a second data signal, and a drain is electrically coupled to a second data line; a fifth thin film transistor, and a gate of the fifth thin film transistor is electrically coupled to the second branch control signal, and a source is electrically coupled to the second data signal, and a drain is electrically coupled to a third data line; and a sixth thin film transistor, and a gate of the sixth thin film transistor is electrically coupled to the third branch control signal, and a source is electrically coupled to a second data signal, and a drain is electrically coupled to a fifth data line;

the third demultiplex module comprises: a seventh thin film transistor, and a gate of the seventh thin film transistor is electrically coupled to the first branch control signal, and a source is electrically coupled to a third data signal, and a drain is electrically coupled to a seventh data line; an eighth thin film transistor, and a gate of the eighth thin film transistor is electrically coupled to the second branch control signal, and a source is electrically coupled to the third data signal, and a drain is electrically coupled to a ninth data line; and a ninth thin film transistor, and a gate of the ninth thin film transistor is electrically coupled to the third branch control signal, and a source is electrically coupled to a third data signal, and a drain is electrically coupled to a twelfth data line;

the fourth demultiplex module comprises: a tenth thin film transistor, and a gate of the tenth thin film transistor is electrically coupled to the first branch control signal, and a source is electrically coupled to a fourth data signal, and a drain is electrically coupled to an eighth data line; an eleventh thin film transistor, and a gate of the eleventh thin film transistor is electrically coupled to the second branch control signal, and a source is electrically coupled to the fourth data signal, and a drain is electrically coupled to a tenth data line; and a twelfth thin film transistor, and a gate of the twelfth thin film transistor is electrically coupled to the third branch control signal, and a source is electrically coupled to a fourth data signal, and a drain is electrically coupled to an eleventh data line;

the fifth demultiplex module comprises: a thirteenth thin film transistor, and a gate of the thirteenth thin film transistor is electrically coupled to the first branch control signal, and a source is electrically coupled to a fifth data signal, and a drain is electrically coupled to a fourteenth data line; a fourteenth thin film transistor, and a gate of the fourteenth thin film transistor is electrically coupled to the second branch control signal, and a source is electrically coupled to the fifth data signal, and a drain is electrically coupled to a fifteenth data line; and a fifteenth thin film transistor, and a gate of the fifteenth thin film transistor is electrically coupled to the third branch control signal, and a source is electrically coupled to a fifth data signal, and a drain is electrically coupled to a seventeenth data line;

the sixth demultiplex module comprises: a sixteenth thin film transistor, and a gate of the sixteenth thin film transistor is electrically coupled to the first branch control signal, and a source is electrically coupled to a sixth data signal, and a drain is electrically coupled to a thirteenth data line; a seventeenth thin film transistor, and a gate of the seventeenth thin film transistor is electrically coupled to the second branch control signal, and a source is electrically coupled to the sixth data signal, and a drain is electrically coupled to a sixteenth data line; and an eighteenth thin film transistor, and a gate of the eighteenth thin film transistor is electrically coupled to the third branch control signal, and a source is electrically coupled to a sixth data signal, and a drain is electrically coupled to an eighteenth data line;

the seventh demultiplex module comprises: a nineteenth thin film transistor, and a gate of the nineteenth thin film transistor is electrically coupled to the first branch control signal, and a source is electrically coupled to a seventh data signal, and a drain is electrically coupled to a twelfth data line; a twentieth thin film transistor, and a gate of the twentieth thin film transistor is electrically coupled to the second branch control signal, and a source is electrically coupled to the seventh data signal, and a drain is electrically coupled to a twenty-second data line; and an twenty-first thin film transistor, and a gate of the twenty-first thin film transistor is electrically coupled to the third branch control signal, and a source is electrically coupled to a seventh data signal, and a drain is electrically coupled to a twenty-third data line;

the eighth demultiplex module comprises: a twenty-second thin film transistor, and a gate of the twenty-second thin film transistor is electrically coupled to the first branch control signal, and a source is electrically coupled to an eighth data signal, and a drain is electrically coupled to a nineteenth data line; a twenty-third thin film transistor, and a gate of the twenty-third thin film transistor is electrically coupled to the second branch control signal, and a source is electrically coupled to the eighth data signal, and a drain is electrically coupled to a twenty-first data line; and an twenty-fourth thin film transistor, and a gate of the twenty-fourth thin film transistor is electrically coupled to the third branch control signal, and a source is electrically coupled to an eighth data signal, and a drain is electrically coupled to a twenty-fourth data line;

polarities of two adjacent data signals are opposite.

Each sun pixel comprises a thin film transistor and a sub pixel electrode; a gate of the thin film transistor is electrically coupled to the scan line corresponded with the row where the sub pixel is, and a source is electrically coupled to the data line corresponded with the column where the sub pixel is, and a drain is electrically coupled to the pixel electrode.

The sub pixels comprise: red sub pixels, green sub pixels, blue sub pixels and white sub pixels; and one red sub pixel, one green sub pixel, one blue sub pixel and one white sub pixel commonly construct one display pixel.

The polarities of the sub pixels of the same column are the same; in the display pixels of the same row, the polarities of sub pixels of the same color in the display pixels of two adjacent columns are different; in the display pixels of the same column, the polarities of sub pixels of the same color in the display pixels of two adjacent rows are different.

In the display pixels of the first row, the green sub pixel, the blue sub pixel, the red sub pixel and the white sub pixel are sequentially aligned; in the display pixels of the second row, the red sub pixel, the white sub pixel, the green sub pixel and the blue sub pixel are sequentially aligned; in the display pixels of the third row, the green sub pixel, the red sub pixel, the blue sub pixel and the white sub pixel are sequentially aligned; in the display pixels of the fourth row, the blue sub pixel, the white sub pixel, the green sub pixel and the red sub pixel are sequentially aligned.

The scan line receives a scan signal.

Pulse durations of the first, second and third branch control signals are ⅓ of a pulse duration of the scan signal.

In a pulse duration of one scan signal, a rising edge of the first branch control signal and a rising edge of the scan signal are generated at the same time, and a rising edge of the second branch control signal and a falling edge of the first branch control signal are generated at the same time, and a rising edge of the third branch control signal and a falling edge of the second branch control signal are generated at the same time, and a falling edge of the third branch control signal and a falling edge of the scan signal are generated at the same time.

Preferably, all the first, third, fifth and seventh data signals have a positive polarity, and all the second, fourth, sixth and eighth data signals have a negative polarity.

Polarities of the sub pixels of the first to third columns respectively are: positive, negative, negative; polarities of the sub pixels of the fourth to sixth columns respectively are: positive, negative, positive; polarities of the sub pixels of the seventh to ninth columns respectively are: positive, negative, positive; polarities of the sub pixels of the tenth to twelfth columns respectively are: negative, negative, positive; polarities of the sub pixels of the thirteenth to fifteenth columns respectively are: negative, positive, positive; polarities of the sub pixels of the sixteenth to eighteenth columns respectively are: negative, positive, negative; polarities of the sub pixels of the nineteenth to twenty-first columns respectively are: negative, positive, negative; polarities of the sub pixels of the twenty-second to twenty-fourth columns respectively are: positive, positive, negative.

The present invention further provides a demultiplex type display driving circuit, comprising: a plurality of driving units, and each driving unit comprises: twenty-four data lines, which are mutually parallel, sequentially aligned and vertical, at least two scan lines, which are mutually parallel, sequentially aligned and horizontal, sub pixels of at least two rows-twenty-four columns, and forty-eight in total, which are aligned in array, and eight demultiplex modules;

each sub pixel is electrically coupled to the scan line corresponded with the row where the sub pixel is and the data line corresponded with the column where the sub pixel is;

each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line, respectively;

the first demultiplex module comprises: a first thin film transistor, and a gate of the first thin film transistor is electrically coupled to the first branch control signal, and a source is electrically coupled to a first data signal, and a drain is electrically coupled to a first data line; a second thin film transistor, and a gate of the second thin film transistor is electrically coupled to the second branch control signal, and a source is electrically coupled to the first data signal, and a drain is electrically coupled to a fourth data line; and a third thin film transistor, and a gate of the third thin film transistor is electrically coupled to the third branch control signal, and a source is electrically coupled to a first data signal, and a drain is electrically coupled to a sixth data line;

the second demultiplex module comprises: a fourth thin film transistor, and a gate of the fourth thin film transistor is electrically coupled to the first branch control signal, and a source is electrically coupled to a second data signal, and a drain is electrically coupled to a second data line; a fifth thin film transistor, and a gate of the fifth thin film transistor is electrically coupled to the second branch control signal, and a source is electrically coupled to the second data signal, and a drain is electrically coupled to a third data line; and a sixth thin film transistor, and a gate of the sixth thin film transistor is electrically coupled to the third branch control signal, and a source is electrically coupled to a second data signal, and a drain is electrically coupled to a fifth data line;

the third demultiplex module comprises: a seventh thin film transistor, and a gate of the seventh thin film transistor is electrically coupled to the first branch control signal, and a source is electrically coupled to a third data signal, and a drain is electrically coupled to a seventh data line; an eighth thin film transistor, and a gate of the eighth thin film transistor is electrically coupled to the second branch control signal, and a source is electrically coupled to the third data signal, and a drain is electrically coupled to a ninth data line; and a ninth thin film transistor, and a gate of the ninth thin film transistor is electrically coupled to the third branch control signal, and a source is electrically coupled to a third data signal, and a drain is electrically coupled to a twelfth data line;

the fourth demultiplex module comprises: a tenth thin film transistor, and a gate of the tenth thin film transistor is electrically coupled to the first branch control signal, and a source is electrically coupled to a fourth data signal, and a drain is electrically coupled to an eighth data line; an eleventh thin film transistor, and a gate of the eleventh thin film transistor is electrically coupled to the second branch control signal, and a source is electrically coupled to the fourth data signal, and a drain is electrically coupled to a tenth data line; and a twelfth thin film transistor, and a gate of the twelfth thin film transistor is electrically coupled to the third branch control signal, and a source is electrically coupled to a fourth data signal, and a drain is electrically coupled to an eleventh data line;

the fifth demultiplex module comprises: a thirteenth thin film transistor, and a gate of the thirteenth thin film transistor is electrically coupled to the first branch control signal, and a source is electrically coupled to a fifth data signal, and a drain is electrically coupled to a fourteenth data line; a fourteenth thin film transistor, and a gate of the fourteenth thin film transistor is electrically coupled to the second branch control signal, and a source is electrically coupled to the fifth data signal, and a drain is electrically coupled to a fifteenth data line; and a fifteenth thin film transistor, and a gate of the fifteenth thin film transistor is electrically coupled to the third branch control signal, and a source is electrically coupled to a fifth data signal, and a drain is electrically coupled to a seventeenth data line;

the sixth demultiplex module comprises: a sixteenth thin film transistor, and a gate of the sixteenth thin film transistor is electrically coupled to the first branch control signal, and a source is electrically coupled to a sixth data signal, and a drain is electrically coupled to a thirteenth data line; a seventeenth thin film transistor, and a gate of the seventeenth thin film transistor is electrically coupled to the second branch control signal, and a source is electrically coupled to the sixth data signal, and a drain is electrically coupled to a sixteenth data line; and an eighteenth thin film transistor, and a gate of the eighteenth thin film transistor is electrically coupled to the third branch control signal, and a source is electrically coupled to a sixth data signal, and a drain is electrically coupled to an eighteenth data line;

the seventh demultiplex module comprises: a nineteenth thin film transistor, and a gate of the nineteenth thin film transistor is electrically coupled to the first branch control signal, and a source is electrically coupled to a seventh data signal, and a drain is electrically coupled to a twelfth data line; a twentieth thin film transistor, and a gate of the twentieth thin film transistor is electrically coupled to the second branch control signal, and a source is electrically coupled to the seventh data signal, and a drain is electrically coupled to a twenty-second data line; and an twenty-first thin film transistor, and a gate of the twenty-first thin film transistor is electrically coupled to the third branch control signal, and a source is electrically coupled to a seventh data signal, and a drain is electrically coupled to a twenty-third data line;

the eighth demultiplex module comprises: a twenty-second thin film transistor, and a gate of the twenty-second thin film transistor is electrically coupled to the first branch control signal, and a source is electrically coupled to an eighth data signal, and a drain is electrically coupled to a nineteenth data line; a twenty-third thin film transistor, and a gate of the twenty-third thin film transistor is electrically coupled to the second branch control signal, and a source is electrically coupled to the eighth data signal, and a drain is electrically coupled to a twenty-first data line; and an twenty-fourth thin film transistor, and a gate of the twenty-fourth thin film transistor is electrically coupled to the third branch control signal, and a source is electrically coupled to an eighth data signal, and a drain is electrically coupled to a twenty-fourth data line;

polarities of two adjacent data signals are opposite;

wherein each sun pixel comprises a thin film transistor and a sub pixel electrode; a gate of the thin film transistor is electrically coupled to the scan line corresponded with the row where the sub pixel is, and a source is electrically coupled to the data line corresponded with the column where the sub pixel is, and a drain is electrically coupled to the pixel electrode;

wherein the sub pixels comprise: red sub pixels, green sub pixels, blue sub pixels and white sub pixels; and one red sub pixel, one green sub pixel, one blue sub pixel and one white sub pixel commonly construct one display pixel;

wherein the scan line receives a scan signal;

wherein all the first, third, fifth and seventh data signals have a positive polarity, and all the second, fourth, sixth and eighth data signals have a negative polarity.

The benefits of the present invention are: the present invention provides a demultiplex type display driving circuit, applied in a RGBW four colors pixel structure display device with high resolution, comprising a plurality of driving units, and each driving unit comprises eight demultiplex modules, and each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line in a jump manner, respectively. Thus, the pulse duration of each branch control signal is equal to ⅓ of a pulse duration of the scan signal to increase the charging time of the data signal and promote the charging rate of the sub pixel under circumstance that the pulse duration of the scan signal is not changed.

BRIEF DESCRIPTION OF THE DRAWINGS

In order to better understand the characteristics and technical aspect of the invention, please refer to the following detailed description of the present invention is concerned with the diagrams, however, provide reference to the accompanying drawings and description only and is not intended to be limiting of the invention.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
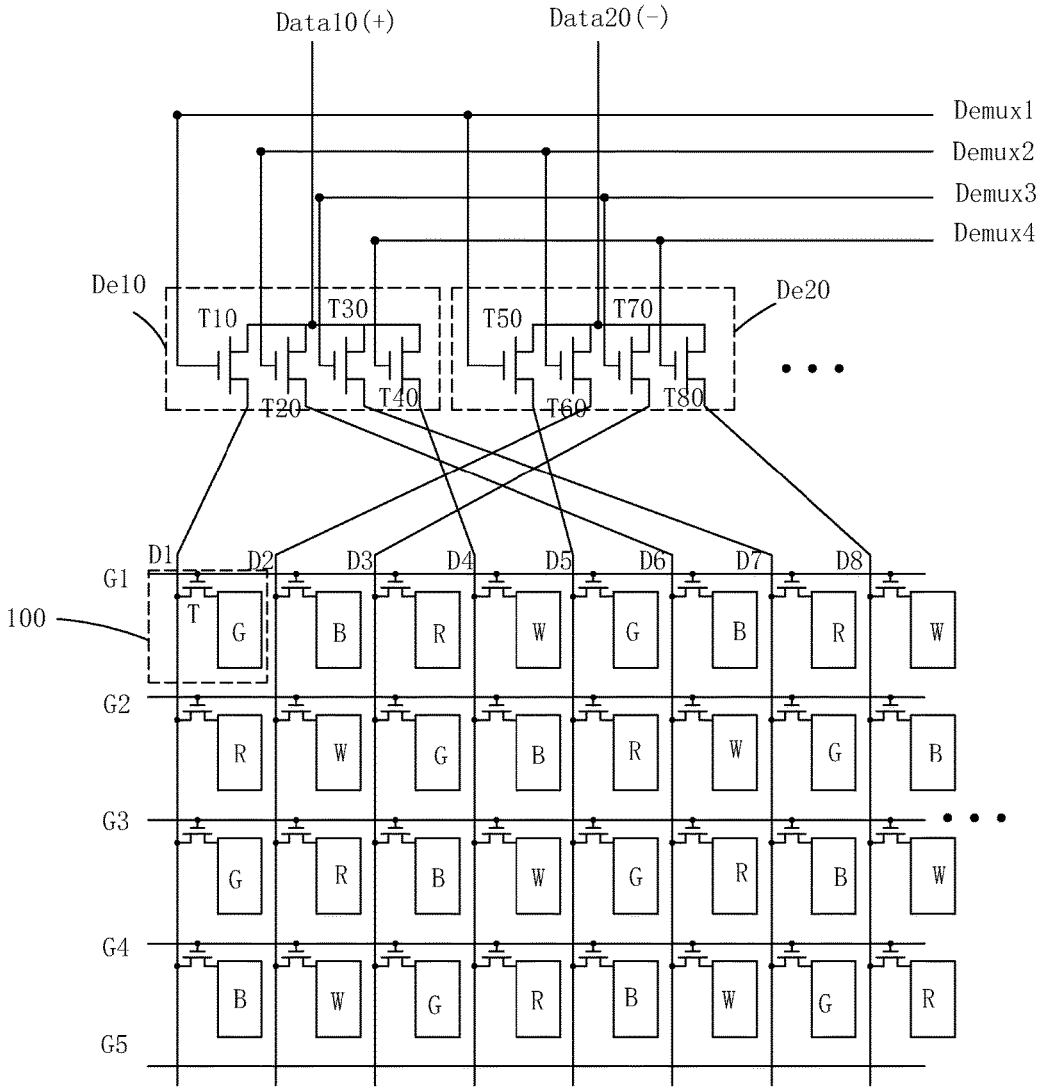
FIG. 1 is a diagram of a demultiplex type display driving circuit used in a RGBW four colors pixel structure display device according to prior art.
Figure 2:
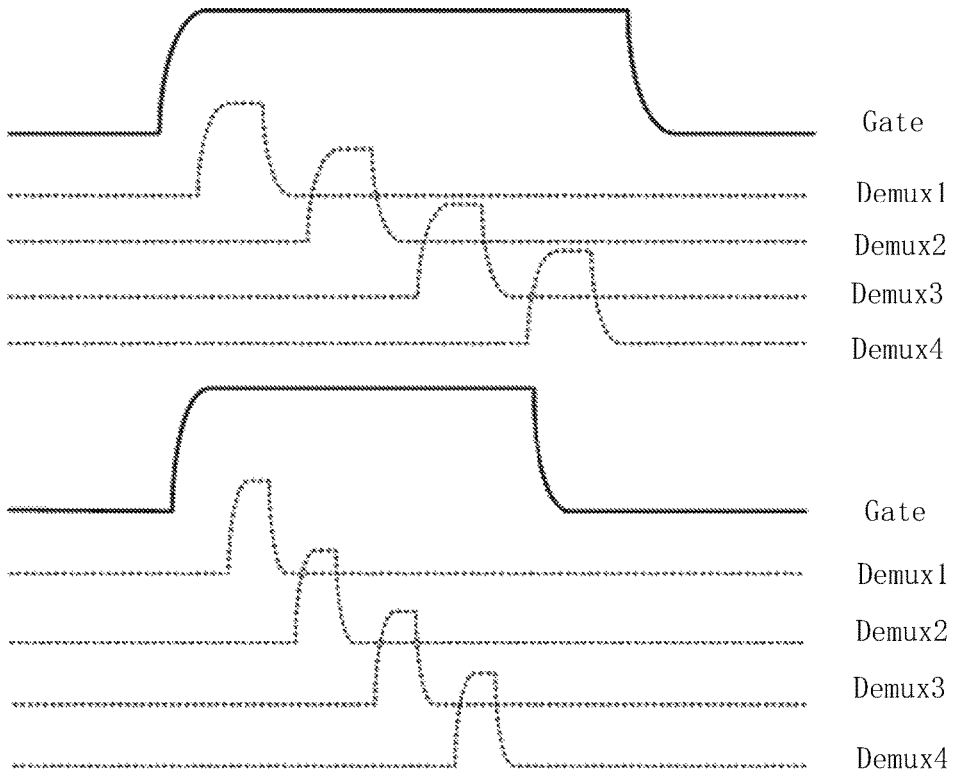
FIG. 2 is a comparison diagram of branch control signals of the demultiplex type display driving circuit shown in FIG. 1 with various resolutions.
Figure 3:
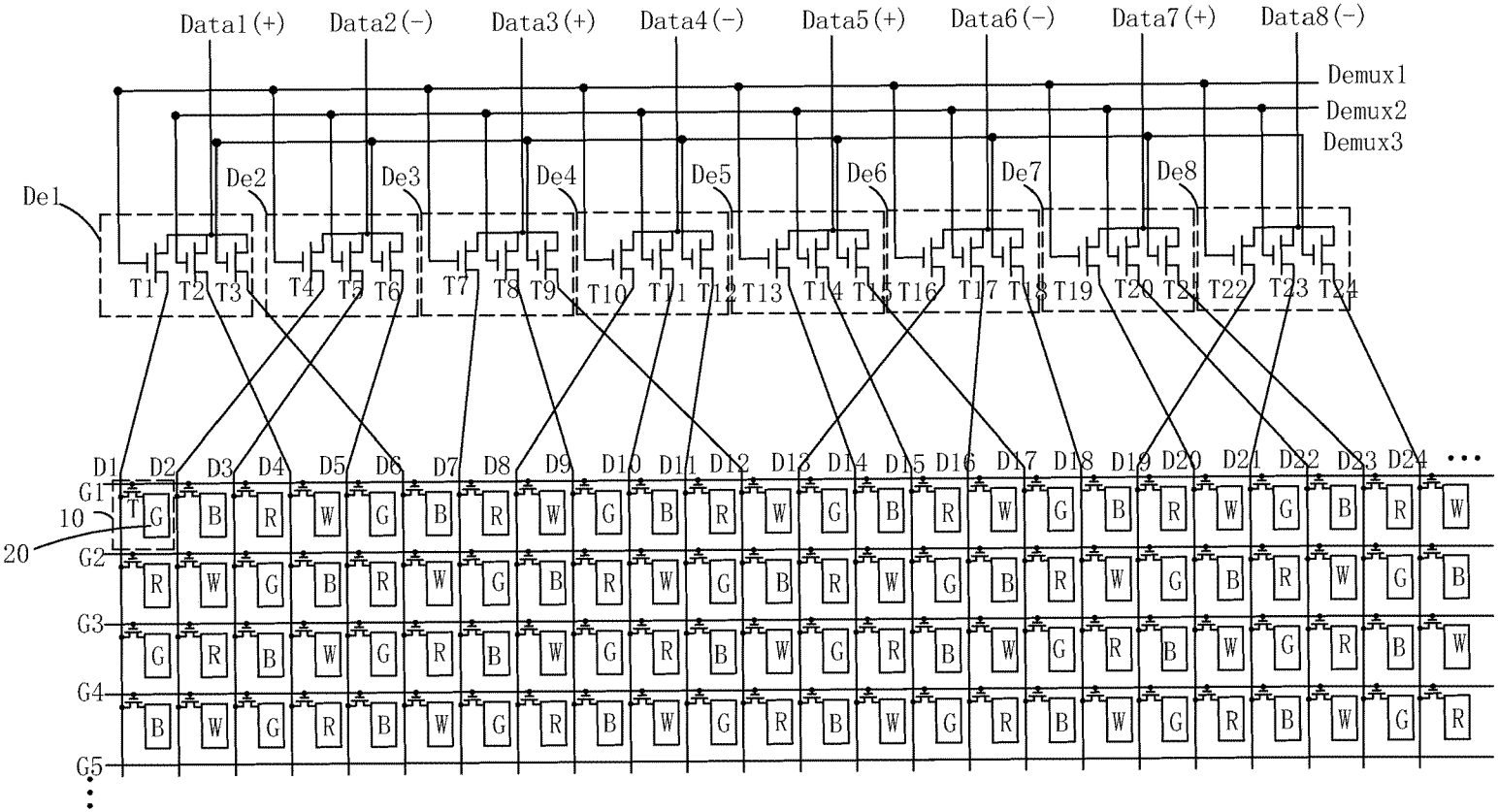
FIG. 3 is a diagram of a demultiplex type display driving circuit according to the present invention.

Please refer to FIG. 3. The present invention provides a demultiplex type display driving circuit, comprising: a plurality of driving units, and each driving unit comprises: twenty-four data lines D1-D24, which are mutually parallel, sequentially aligned and vertical, at least two scan lines Gn (n is a positive integer), which are mutually parallel, sequentially aligned and horizontal, sub pixels 10 of at least two rows-twenty-four columns, and forty-eight in total, which are aligned in array, and eight demultiplex modules De1-De8.

each sub pixel is electrically coupled to the scan line corresponded with the row where the sub pixel is and the data line corresponded with the column where the sub pixel is;

each demultiplex module comprises three thin film transistors, and gates of the three thin film transistors are electrically coupled to a first branch control signal Demux1, a second branch control signal Demux2, and a third branch control signal Demux3 respectively, and source are all electrically coupled to the same data signal, and drains are electrically coupled to one data line, respectively;

the first demultiplex module De1 comprises: a first thin film transistor T1, and a gate of the first thin film transistor T1 is electrically coupled to the first branch control signal Demux1, and a source is electrically coupled to a first data signal Data1, and a drain is electrically coupled to a first data line D1; a second thin film transistor T2, and a gate of the second thin film transistor T2 is electrically coupled to the second branch control signal Demux2, and a source is electrically coupled to the first data signal Data1, and a drain is electrically coupled to a fourth data line D4; and a third thin film transistor T3, and a gate of the third thin film transistor T3 is electrically coupled to the third branch control signal Demux3, and a source is electrically coupled to a first data signal Data1, and a drain is electrically coupled to a sixth data line D6;

the second demultiplex module De2 comprises: a fourth thin film transistor T4, and a gate of the fourth thin film transistor T4 is electrically coupled to the first branch control signal Demux1, and a source is electrically coupled to a second data signal Data2, and a drain is electrically coupled to a second data line D2; a fifth thin film transistor T5, and a gate of the fifth thin film transistor T5 is electrically coupled to the second branch control signal Demux2, and a source is electrically coupled to the second data signal Data2, and a drain is electrically coupled to a third data line D3; and a sixth thin film transistor T6, and a gate of the sixth thin film transistor T6 is electrically coupled to the third branch control signal Demux3, and a source is electrically coupled to a second data signal Data2, and a drain is electrically coupled to a fifth data line D5;

the third demultiplex module De3 comprises: a seventh thin film transistor T7, and a gate of the seventh thin film transistor T7 is electrically coupled to the first branch control signal Demux1, and a source is electrically coupled to a third data signal Data3, and a drain is electrically coupled to a seventh data line D7; an eighth thin film transistor T8, and a gate of the eighth thin film transistor T8 is electrically coupled to the second branch control signal Demux2, and a source is electrically coupled to the third data signal Data3, and a drain is electrically coupled to a ninth data line D9; and a ninth thin film transistor T9, and a gate of the ninth thin film transistor T9 is electrically coupled to the third branch control signal Demux3, and a source is electrically coupled to a third data signal Data3, and a drain is electrically coupled to a twelfth data line D12;

the fourth demultiplex module De4 comprises: a tenth thin film transistor T10, and a gate of the tenth thin film transistor T10 is electrically coupled to the first branch control signal Demux1, and a source is electrically coupled to a fourth data signal Data4, and a drain is electrically coupled to an eighth data line D8; an eleventh thin film transistor T11, and a gate of the eleventh thin film transistor T11 is electrically coupled to the second branch control signal Demux2, and a source is electrically coupled to the fourth data signal Data4, and a drain is electrically coupled to a tenth data line D10; and a twelfth thin film transistor T12, and a gate of the twelfth thin film transistor T12 is electrically coupled to the third branch control signal Demux3, and a source is electrically coupled to a fourth data signal Data4, and a drain is electrically coupled to an eleventh data line D11;

the fifth demultiplex module De5 comprises: a thirteenth thin film transistor T13, and a gate of the thirteenth thin film transistor T13 is electrically coupled to the first branch control signal Demux1, and a source is electrically coupled to a fifth data signal Data5, and a drain is electrically coupled to a fourteenth data line D14; a fourteenth thin film transistor T14, and a gate of the fourteenth thin film transistor T14 is electrically coupled to the second branch control signal Demux2, and a source is electrically coupled to the fifth data signal Data5, and a drain is electrically coupled to a fifteenth data line D15; and a fifteenth thin film transistor T15, and a gate of the fifteenth thin film transistor T15 is electrically coupled to the third branch control signal Demux3, and a source is electrically coupled to a fifth data signal Data5, and a drain is electrically coupled to a seventeenth data line D17;

the sixth demultiplex module De6 comprises: a sixteenth thin film transistor T16, and a gate of the sixteenth thin film transistor T16 is electrically coupled to the first branch control signal Demux1, and a source is electrically coupled to a sixth data signal Data6, and a drain is electrically coupled to a thirteenth data line D13; a seventeenth thin film transistor T17, and a gate of the seventeenth thin film transistor T17 is electrically coupled to the second branch control signal Demux2, and a source is electrically coupled to the sixth data signal Data6, and a drain is electrically coupled to a sixteenth data line D16; and an eighteenth thin film transistor T18, and a gate of the eighteenth thin film transistor T18 is electrically coupled to the third branch control signal Demux3, and a source is electrically coupled to a sixth data signal Data6, and a drain is electrically coupled to an eighteenth data line D18;

the seventh demultiplex module De7 comprises: a nineteenth thin film transistor T19, and a gate of the nineteenth thin film transistor T19 is electrically coupled to the first branch control signal Demux1, and a source is electrically coupled to a seventh data signal Data7, and a drain is electrically coupled to a twelfth data line D20; a twentieth thin film transistor T20, and a gate of the twentieth thin film transistor T20 is electrically coupled to the second branch control signal Demux2, and a source is electrically coupled to the seventh data signal Data7, and a drain is electrically coupled to a twenty-second data line D22; and an twenty-first thin film transistor T21, and a gate of the twenty-first thin film transistor T21 is electrically coupled to the third branch control signal Demux3, and a source is electrically coupled to a seventh data signal Data7, and a drain is electrically coupled to a twenty-third data line D23;

the eighth demultiplex module De8 comprises: a twenty-second thin film transistor T22, and a gate of the twenty-second thin film transistor T22 is electrically coupled to the first branch control signal Demux1, and a source is electrically coupled to an eighth data signal Data8, and a drain is electrically coupled to a nineteenth data line D19; a twenty-third thin film transistor T23, and a gate of the twenty-third thin film transistor T23 is electrically coupled to the second branch control signal Demux2, and a source is electrically coupled to the eighth data signal Data8, and a drain is electrically coupled to a twenty-first data line D21; and an twenty-fourth thin film transistor T24, and a gate of the twenty-fourth thin film transistor T24 is electrically coupled to the third branch control signal Demux3, and a source is electrically coupled to an eighth data signal Data8, and a drain is electrically coupled to a twenty-fourth data line D24.

Polarities of two adjacent data signals are opposite. Preferably, all the first, third, fifth and seventh data signals Data1, Data3, Data5, Data7 have a positive polarity, and all the second, fourth, sixth and eighth data signals Data2, Data4, Data6, Data8 have a negative polarity. Because the drains of the three thin film transistors in each demultiplex module are respectively coupled to one data line in the aforesaid jump manner, polarities of the sub pixels 10 of the first to third columns respectively are: positive, negative, negative; polarities of the sub pixels 10 of the fourth to sixth columns respectively are: positive, negative, positive; polarities of the sub pixels 10 of the seventh to ninth columns respectively are: positive, negative, positive; polarities of the sub pixels 10 of the tenth to twelfth columns respectively are: negative, negative, positive; polarities of the sub pixels 10 of the thirteenth to fifteenth columns respectively are: negative, positive, positive; polarities of the sub pixels 10 of the sixteenth to eighteenth columns respectively are: negative, positive, negative; polarities of the sub pixels 10 of the nineteenth to twenty-first columns respectively are: negative, positive, negative; polarities of the sub pixels 10 of the twenty-second to twenty-fourth columns respectively are: positive, positive, negative.

Specifically, each sub pixel 10 comprises one thin film transistor T and one pixel electrode 20. A gate of the thin film transistor T is electrically coupled to the scan line corresponded with the row where the sub pixel 10 is, and a source is electrically coupled to the data line corresponded with the column where the sub pixel 10 is, and a drain is electrically coupled to the pixel electrode 20.

Furthermore, the sub pixels 10 comprise: red sub pixels R, green sub pixels G, blue sub pixels B and white sub pixels W; and one red sub pixel R, one green sub pixel G, one blue sub pixel B and one white sub pixel W commonly construct one display pixel. As shown in FIG. 3, in the display pixels of the first row, the green sub pixel G, the blue sub pixel B, the red sub pixel R and the white sub pixel W are sequentially aligned; in the display pixels of the second row, the red sub pixel R, the white sub pixel W, the green sub pixel G and the blue sub pixel B are sequentially aligned; in the display pixels of the third row, the green sub pixel G, the red sub pixel R, the blue sub pixel B and the white sub pixel W are sequentially aligned; in the display pixels of the fourth row, the blue sub pixel B, the white sub pixel W, the green sub pixel G and the red sub pixel R are sequentially aligned. With such sub pixel alignment with the wiring of the aforesaid each demultiplex module, the polarities of the sub pixels 10 of the same column are the same; in the display pixels of the same row, the polarities of sub pixels of the same color in the display pixels of two adjacent columns are different; in the display pixels of the same column, the polarities of sub pixels of the same color in the display pixels of two adjacent rows are different. In the pure color image, the positive, negative polarities of the sub pixels of the same color cancel out each other to prevent the picture crosstalk and to ensure the display quality.

The scan line receives the scan signal Gate, and the scan signal Gate is provided by the gate driver, and the data signal is provided by the source driver.

Figure 4:
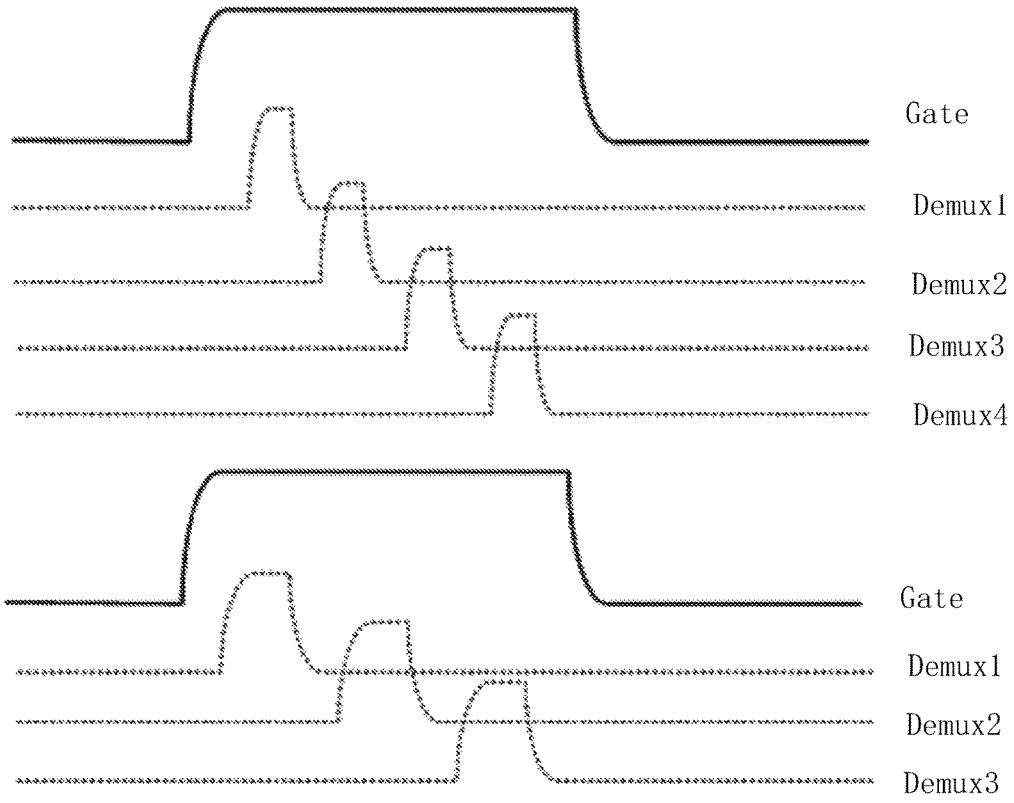
FIG. 4 is a comparison diagram of branch control signals of the demultiplex type display driving circuit according to the present invention and the demultiplex type display driving circuit shown in FIG. 1 with the same high resolution.

Particularly, referring to FIG. 4, pulse durations of the first, second and third branch control signals Demux1, Demux2, Demux3 are ⅓ of a pulse duration of the scan signal. In a pulse duration of one scan signal Gate, a rising edge of the first branch control signal Demux1 and a rising edge of the scan signal Gate are generated at the same time, and a rising edge of the second branch control signal Demux2 and a falling edge of the first branch control signal Demux1 are generated at the same time, and a rising edge of the third branch control signal Demux3 and a falling edge of the second branch control signal Demux2 are generated at the same time, and a falling edge of the third branch control signal Demux3 and a falling edge of the scan signal Gate are generated at the same time. As the RGBW four colors pixel structure display device perform high resolution display, in the pulse duration of the same shorter scan signal Gate, the demultiplex type display driving circuit of the present invention comprises three branch control signals. In comparison with prior art, the pulse duration of each branch control signal is increased from ¼ to ⅓ of the pulse duration of the scan signal, and the activation time of sub pixels 10 of each column can be extended. Accordingly, the present invention can increase the charging time of the data signal and promote the charging rate of the sub pixel 10 under circumstance that the pulse duration of the scan signal Gate is not changed.

In conclusion, the demultiplex type display driving circuit of the present invention is applied in a RGBW four colors pixel structure display device with high resolution, and comprises a plurality of driving units, and each driving unit comprises eight demultiplex modules, and each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line in a jump manner, respectively. Thus, the pulse duration of each branch control signal is equal to ⅓ of a pulse duration of the scan signal to increase the charging time of the data signal and promote the charging rate of the sub pixel under circumstance that the pulse duration of the scan signal is not changed.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. A demultiplex type display driving circuit, comprising: a plurality of driving units, and each driving unit comprises: twenty-four data lines, which are mutually parallel, sequentially aligned and vertical, at least two scan lines, which are mutually parallel, sequentially aligned and horizontal, sub pixels of at least two rows-twenty-four columns, and forty-eight in total, which are aligned in array, and eight demultiplex modules;

each sub pixel is electrically coupled to the scan line corresponded with the row where the sub pixel is and the data line corresponded with the column where the sub pixel is;

each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line, respectively;

the first demultiplex module comprises: a first thin film transistor, and a gate of the first thin film transistor is electrically coupled to the first branch control signal, and a source is electrically coupled to a first data signal, and a drain is electrically coupled to a first data line; a second thin film transistor, and a gate of the second thin film transistor is electrically coupled to the second branch control signal, and a source is electrically coupled to the first data signal, and a drain is electrically coupled to a fourth data line; and a third thin film transistor, and a gate of the third thin film transistor is electrically coupled to the third branch control signal, and a source is electrically coupled to a first data signal, and a drain is electrically coupled to a sixth data line;

the second demultiplex module comprises: a fourth thin film transistor, and a gate of the fourth thin film transistor is electrically coupled to the first branch control signal, and a source is electrically coupled to a second data signal, and a drain is electrically coupled to a second data line; a fifth thin film transistor, and a gate of the fifth thin film transistor is electrically coupled to the second branch control signal, and a source is electrically coupled to the second data signal, and a drain is electrically coupled to a third data line; and a sixth thin film transistor, and a gate of the sixth thin film transistor is electrically coupled to the third branch control signal, and a source is electrically coupled to a second data signal, and a drain is electrically coupled to a fifth data line;

the third demultiplex module comprises: a seventh thin film transistor, and a gate of the seventh thin film transistor is electrically coupled to the first branch control signal, and a source is electrically coupled to a third data signal, and a drain is electrically coupled to a seventh data line; an eighth thin film transistor, and a gate of the eighth thin film transistor is electrically coupled to the second branch control signal, and a source is electrically coupled to the third data signal, and a drain is electrically coupled to a ninth data line; and a ninth thin film transistor, and a gate of the ninth thin film transistor is electrically coupled to the third branch control signal, and a source is electrically coupled to a third data signal, and a drain is electrically coupled to a twelfth data line;

the fourth demultiplex module comprises: a tenth thin film transistor, and a gate of the tenth thin film transistor is electrically coupled to the first branch control signal, and a source is electrically coupled to a fourth data signal, and a drain is electrically coupled to an eighth data line; an eleventh thin film transistor, and a gate of the eleventh thin film transistor is electrically coupled to the second branch control signal, and a source is electrically coupled to the fourth data signal, and a drain is electrically coupled to a tenth data line; and a twelfth thin film transistor, and a gate of the twelfth thin film transistor is electrically coupled to the third branch control signal, and a source is electrically coupled to a fourth data signal, and a drain is electrically coupled to an eleventh data line;

the fifth demultiplex module comprises: a thirteenth thin film transistor, and a gate of the thirteenth thin film transistor is electrically coupled to the first branch control signal, and a source is electrically coupled to a fifth data signal, and a drain is electrically coupled to a fourteenth data line; a fourteenth thin film transistor, and a gate of the fourteenth thin film transistor is electrically coupled to the second branch control signal, and a source is electrically coupled to the fifth data signal, and a drain is electrically coupled to a fifteenth data line; and a fifteenth thin film transistor, and a gate of the fifteenth thin film transistor is electrically coupled to the third branch control signal, and a source is electrically coupled to a fifth data signal, and a drain is electrically coupled to a seventeenth data line;

the sixth demultiplex module comprises: a sixteenth thin film transistor, and a gate of the sixteenth thin film transistor is electrically coupled to the first branch control signal, and a source is electrically coupled to a sixth data signal, and a drain is electrically coupled to a thirteenth data line; a seventeenth thin film transistor, and a gate of the seventeenth thin film transistor is electrically coupled to the second branch control signal, and a source is electrically coupled to the sixth data signal, and a drain is electrically coupled to a sixteenth data line; and an eighteenth thin film transistor, and a gate of the eighteenth thin film transistor is electrically coupled to the third branch control signal, and a source is electrically coupled to a sixth data signal, and a drain is electrically coupled to an eighteenth data line;

the seventh demultiplex module comprises: a nineteenth thin film transistor, and a gate of the nineteenth thin film transistor is electrically coupled to the first branch control signal, and a source is electrically coupled to a seventh data signal, and a drain is electrically coupled to a twelfth data line; a twentieth thin film transistor, and a gate of the twentieth thin film transistor is electrically coupled to the second branch control signal, and a source is electrically coupled to the seventh data signal, and a drain is electrically coupled to a twenty-second data line; and an twenty-first thin film transistor, and a gate of the twenty-first thin film transistor is electrically coupled to the third branch control signal, and a source is electrically coupled to a seventh data signal, and a drain is electrically coupled to a twenty-third data line;

the eighth demultiplex module comprises: a twenty-second thin film transistor, and a gate of the twenty-second thin film transistor is electrically coupled to the first branch control signal, and a source is electrically coupled to an eighth data signal, and a drain is electrically coupled to a nineteenth data line; a twenty-third thin film transistor, and a gate of the twenty-third thin film transistor is electrically coupled to the second branch control signal, and a source is electrically coupled to the eighth data signal, and a drain is electrically coupled to a twenty-first data line; and an twenty-fourth thin film transistor, and a gate of the twenty-fourth thin film transistor is electrically coupled to the third branch control signal, and a source is electrically coupled to an eighth data signal, and a drain is electrically coupled to a twenty-fourth data line;

polarities of two adjacent data signals are opposite;

wherein the sub pixels comprise: red sub pixels, green sub pixels, blue sub pixels and white sub pixels; and one red sub pixel, one green sub pixel, one blue sub pixel and one white sub pixel commonly construct one display pixel;

wherein the polarities of the sub pixels of the same column are the same; in the display pixels of the same row, the polarities of sub pixels of the same color in the display pixels of two adjacent columns are different; in the display pixels of the same column, the polarities of sub pixels of the same color in the display pixels of two adjacent rows are different; and wherein in the display pixels of the first row, the green sub pixel, the blue sub pixel, the red sub pixel and the white sub pixel are sequentially aligned; in the display pixels of the second row, the red sub pixel, the white sub pixel, the green sub pixel and the blue sub pixel are sequentially aligned; in the display pixels of the third row, the green sub pixel, the red sub pixel, the blue sub pixel and the white sub pixel are sequentially aligned; in the display pixels of the fourth row, the blue sub pixel, the white sub pixel, the green sub pixel and the red sub pixel are sequentially aligned.

2. The demultiplex type display driving circuit according to claim 1, wherein each sub pixel comprises a thin film transistor and a sub pixel electrode; a gate of the thin film transistor is electrically coupled to the scan line corresponded with the row where the sub pixel is, and a source is electrically coupled to the data line corresponded with the column where the sub pixel is, and a drain is electrically coupled to the pixel electrode.

3. The demultiplex type display driving circuit according to claim 1, wherein the scan line receives a scan signal.

4. The demultiplex type display driving circuit according to claim 3, wherein pulse durations of the first, second and third branch control signals are ⅓ of a pulse duration of the scan signal.

5. The demultiplex type display driving circuit according to claim 4, wherein in a pulse duration of one scan signal, a rising edge of the first branch control signal and a rising edge of the scan signal are generated at the same time, and a rising edge of the second branch control signal and a falling edge of the first branch control signal are generated at the same time, and a rising edge of the third branch control signal and a falling edge of the second branch control signal are generated at the same time, and a falling edge of the third branch control signal and a falling edge of the scan signal are generated at the same time.

6. The demultiplex type display driving circuit according to claim 1, wherein all the first, third, fifth and seventh data signals have a positive polarity, and all the second, fourth, sixth and eighth data signals have a negative polarity.

7. The demultiplex type display driving circuit according to claim 6, wherein polarities of the sub pixels of the first to third columns respectively are: positive, negative, negative; polarities of the sub pixels of the fourth to sixth columns respectively are: positive, negative, positive; polarities of the sub pixels of the seventh to ninth columns respectively are: positive, negative, positive; polarities of the sub pixels of the tenth to twelfth columns respectively are: negative, negative, positive; polarities of the sub pixels of the thirteenth to fifteenth columns respectively are: negative, positive, positive; polarities of the sub pixels of the sixteenth to eighteenth columns respectively are: negative, positive, negative; polarities of the sub pixels of the nineteenth to twenty-first columns respectively are: negative, positive, negative; polarities of the sub pixels of the twenty-second to twenty-fourth columns respectively are: positive, positive, negative.

8. A demultiplex type display driving circuit, comprising: a plurality of driving units, and each driving unit comprises: twenty-four data lines, which are mutually parallel, sequentially aligned and vertical, at least two scan lines, which are mutually parallel, sequentially aligned and horizontal, sub pixels of at least two rows-twenty-four columns, and forty-eight in total, which are aligned in array, and eight demultiplex modules;

each sub pixel is electrically coupled to the scan line corresponded with the row where the sub pixel is and the data line corresponded with the column where the sub pixel is;

each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line, respectively;

the first demultiplex module comprises: a first thin film transistor, and a gate of the first thin film transistor is electrically coupled to the first branch control signal, and a source is electrically coupled to a first data signal, and a drain is electrically coupled to a first data line; a second thin film transistor, and a gate of the second thin film transistor is electrically coupled to the second branch control signal, and a source is electrically coupled to the first data signal, and a drain is electrically coupled to a fourth data line; and a third thin film transistor, and a gate of the third thin film transistor is electrically coupled to the third branch control signal, and a source is electrically coupled to a first data signal, and a drain is electrically coupled to a sixth data line;

the second demultiplex module comprises: a fourth thin film transistor, and a gate of the fourth thin film transistor is electrically coupled to the first branch control signal, and a source is electrically coupled to a second data signal, and a drain is electrically coupled to a second data line; a fifth thin film transistor, and a gate of the fifth thin film transistor is electrically coupled to the second branch control signal, and a source is electrically coupled to the second data signal, and a drain is electrically coupled to a third data line; and a sixth thin film transistor, and a gate of the sixth thin film transistor is electrically coupled to the third branch control signal, and a source is electrically coupled to a second data signal, and a drain is electrically coupled to a fifth data line;

the third demultiplex module comprises: a seventh thin film transistor, and a gate of the seventh thin film transistor is electrically coupled to the first branch control signal, and a source is electrically coupled to a third data signal, and a drain is electrically coupled to a seventh data line; an eighth thin film transistor, and a gate of the eighth thin film transistor is electrically coupled to the second branch control signal, and a source is electrically coupled to the third data signal, and a drain is electrically coupled to a ninth data line; and a ninth thin film transistor, and a gate of the ninth thin film transistor is electrically coupled to the third branch control signal, and a source is electrically coupled to a third data signal, and a drain is electrically coupled to a twelfth data line;

the fourth demultiplex module comprises: a tenth thin film transistor, and a gate of the tenth thin film transistor is electrically coupled to the first branch control signal, and a source is electrically coupled to a fourth data signal, and a drain is electrically coupled to an eighth data line; an eleventh thin film transistor, and a gate of the eleventh thin film transistor is electrically coupled to the second branch control signal, and a source is electrically coupled to the fourth data signal, and a drain is electrically coupled to a tenth data line; and a twelfth thin film transistor, and a gate of the twelfth thin film transistor is electrically coupled to the third branch control signal, and a source is electrically coupled to a fourth data signal, and a drain is electrically coupled to an eleventh data line;

the fifth demultiplex module comprises: a thirteenth thin film transistor, and a gate of the thirteenth thin film transistor is electrically coupled to the first branch control signal, and a source is electrically coupled to a fifth data signal, and a drain is electrically coupled to a fourteenth data line; a fourteenth thin film transistor, and a gate of the fourteenth thin film transistor is electrically coupled to the second branch control signal, and a source is electrically coupled to the fifth data signal, and a drain is electrically coupled to a fifteenth data line; and a fifteenth thin film transistor, and a gate of the fifteenth thin film transistor is electrically coupled to the third branch control signal, and a source is electrically coupled to a fifth data signal, and a drain is electrically coupled to a seventeenth data line;

the sixth demultiplex module comprises: a sixteenth thin film transistor, and a gate of the sixteenth thin film transistor is electrically coupled to the first branch control signal, and a source is electrically coupled to a sixth data signal, and a drain is electrically coupled to a thirteenth data line; a seventeenth thin film transistor, and a gate of the seventeenth thin film transistor is electrically coupled to the second branch control signal, and a source is electrically coupled to the sixth data signal, and a drain is electrically coupled to a sixteenth data line; and an eighteenth thin film transistor, and a gate of the eighteenth thin film transistor is electrically coupled to the third branch control signal, and a source is electrically coupled to a sixth data signal, and a drain is electrically coupled to an eighteenth data line;

the seventh demultiplex module comprises: a nineteenth thin film transistor, and a gate of the nineteenth thin film transistor is electrically coupled to the first branch control signal, and a source is electrically coupled to a seventh data signal, and a drain is electrically coupled to a twelfth data line; a twentieth thin film transistor, and a gate of the twentieth thin film transistor is electrically coupled to the second branch control signal, and a source is electrically coupled to the seventh data signal, and a drain is electrically coupled to a twenty-second data line; and an twenty-first thin film transistor, and a gate of the twenty-first thin film transistor is electrically coupled to the third branch control signal, and a source is electrically coupled to a seventh data signal, and a drain is electrically coupled to a twenty-third data line;

the eighth demultiplex module comprises: a twenty-second thin film transistor, and a gate of the twenty-second thin film transistor is electrically coupled to the first branch control signal, and a source is electrically coupled to an eighth data signal, and a drain is electrically coupled to a nineteenth data line; a twenty-third thin film transistor, and a gate of the twenty-third thin film transistor is electrically coupled to the second branch control signal, and a source is electrically coupled to the eighth data signal, and a drain is electrically coupled to a twenty-first data line; and an twenty-fourth thin film transistor, and a gate of the twenty-fourth thin film transistor is electrically coupled to the third branch control signal, and a source is electrically coupled to an eighth data signal, and a drain is electrically coupled to a twenty-fourth data line;

polarities of two adjacent data signals are opposite;

wherein each sub pixel comprises a thin film transistor and a sub pixel electrode; a gate of the thin film transistor is electrically coupled to the scan line corresponded with the row where the sub pixel is, and a source is electrically coupled to the data line corresponded with the column where the sub pixel is, and a drain is electrically coupled to the pixel electrode;

wherein the sub pixels comprise: red sub pixels, green sub pixels, blue sub pixels and white sub pixels; and one red sub pixel, one green sub pixel, one blue sub pixel and one white sub pixel commonly construct one display pixel;

wherein the scan line receives a scan signal;

wherein all the first, third, fifth and seventh data signals have a positive polarity, and all the second, fourth, sixth and eighth data signals have a negative polarity;

wherein the polarities of the sub pixels of the same column are the same; in the display pixels of the same row, the polarities of sub pixels of the same color in the display pixels of two adjacent columns are different; in the display pixels of the same column, the polarities of sub pixels of the same color in the display pixels of two adjacent rows are different; and wherein in the display pixels of the first row, the green sub pixel, the blue sub pixel, the red sub pixel and the white sub pixel are sequentially aligned; in the display pixels of the second row, the red sub pixel, the white sub pixel, the green sub pixel and the blue sub pixel are sequentially aligned; in the display pixels of the third row, the green sub pixel, the red sub pixel, the blue sub pixel and the white sub pixel are sequentially aligned; in the display pixels of the fourth row, the blue sub pixel, the white sub pixel, the green sub pixel and the red sub pixel are sequentially aligned.

9. The demultiplex type display driving circuit according to claim 8, wherein pulse durations of the first, second and third branch control signals are ⅓ of a pulse duration of the scan signal.

10. The demultiplex type display driving circuit according to claim 9, wherein in a pulse duration of one scan signal, a rising edge of the first branch control signal and a rising edge of the scan signal are generated at the same time, and a rising edge of the second branch control signal and a falling edge of the first branch control signal are generated at the same time, and a rising edge of the third branch control signal and a falling edge of the second branch control signal are generated at the same time, and a falling edge of the third branch control signal and a falling edge of the scan signal are generated at the same time.

11. The demultiplex type display driving circuit according to claim 8, wherein polarities of the sub pixels of the first to third columns respectively are: positive, negative, negative; polarities of the sub pixels of the fourth to sixth columns respectively are: positive, negative, positive; polarities of the sub pixels of the seventh to ninth columns respectively are: positive, negative, positive; polarities of the sub pixels of the tenth to twelfth columns respectively are: negative, negative, positive; polarities of the sub pixels of the thirteenth to fifteenth columns respectively are: negative, positive, positive; polarities of the sub pixels of the sixteenth to eighteenth columns respectively are: negative, positive, negative; polarities of the sub pixels of the nineteenth to twenty-first columns respectively are: negative, positive, negative; polarities of the sub pixels of the twenty-second to twenty-fourth columns respectively are: positive, positive, negative.

12. A demultiplex type display driving circuit, comprising: a plurality of driving units, and each driving unit comprises: twenty-four data lines, which are mutually parallel, sequentially aligned and vertical, at least two scan lines, which are mutually parallel, sequentially aligned and horizontal, sub pixels of at least two rows-twenty-four columns, and forty-eight in total, which are aligned in array, and eight demultiplex modules;

each sub pixel is electrically coupled to the scan line corresponded with the row where the sub pixel is and the data line corresponded with the column where the sub pixel is;

each demultiplex module comprises three thin film transistors, and gates of the three thin film transistors are electrically coupled to a first branch control signal, a second branch control signal, and a third branch control signal respectively, and source are all electrically coupled to the same data signal, and drains are electrically coupled to one data line, respectively;

the first demultiplex module comprises: a first thin film transistor, and a gate of the first thin film transistor is electrically coupled to the first branch control signal, and a source is electrically coupled to a first data signal, and a drain is electrically coupled to a first data line; a second thin film transistor, and a gate of the second thin film transistor is electrically coupled to the second branch control signal, and a source is electrically coupled to the first data signal, and a drain is electrically coupled to a fourth data line; and a third thin film transistor, and a gate of the third thin film transistor is electrically coupled to the third branch control signal, and a source is electrically coupled to a first data signal, and a drain is electrically coupled to a sixth data line;

the second demultiplex module comprises: a fourth thin film transistor, and a gate of the fourth thin film transistor is electrically coupled to the first branch control signal, and a source is electrically coupled to a second data signal, and a drain is electrically coupled to a second data line; a fifth thin film transistor, and a gate of the fifth thin film transistor is electrically coupled to the second branch control signal, and a source is electrically coupled to the second data signal, and a drain is electrically coupled to a third data line; and a sixth thin film transistor, and a gate of the sixth thin film transistor is electrically coupled to the third branch control signal, and a source is electrically coupled to a second data signal, and a drain is electrically coupled to a fifth data line;

the third demultiplex module comprises: a seventh thin film transistor, and a gate of the seventh thin film transistor is electrically coupled to the first branch control signal, and a source is electrically coupled to a third data signal, and a drain is electrically coupled to a seventh data line; an eighth thin film transistor, and a gate of the eighth thin film transistor is electrically coupled to the second branch control signal, and a source is electrically coupled to the third data signal, and a drain is electrically coupled to a ninth data line; and a ninth thin film transistor, and a gate of the ninth thin film transistor is electrically coupled to the third branch control signal, and a source is electrically coupled to a third data signal, and a drain is electrically coupled to a twelfth data line;

the fourth demultiplex module comprises: a tenth thin film transistor, and a gate of the tenth thin film transistor is electrically coupled to the first branch control signal, and a source is electrically coupled to a fourth data signal, and a drain is electrically coupled to an eighth data line; an eleventh thin film transistor, and a gate of the eleventh thin film transistor is electrically coupled to the second branch control signal, and a source is electrically coupled to the fourth data signal, and a drain is electrically coupled to a tenth data line; and a twelfth thin film transistor, and a gate of the twelfth thin film transistor is electrically coupled to the third branch control signal, and a source is electrically coupled to a fourth data signal, and a drain is electrically coupled to an eleventh data line;

the fifth demultiplex module comprises: a thirteenth thin film transistor, and a gate of the thirteenth thin film transistor is electrically coupled to the first branch control signal, and a source is electrically coupled to a fifth data signal, and a drain is electrically coupled to a fourteenth data line; a fourteenth thin film transistor, and a gate of the fourteenth thin film transistor is electrically coupled to the second branch control signal, and a source is electrically coupled to the fifth data signal, and a drain is electrically coupled to a fifteenth data line; and a fifteenth thin film transistor, and a gate of the fifteenth thin film transistor is electrically coupled to the third branch control signal, and a source is electrically coupled to a fifth data signal, and a drain is electrically coupled to a seventeenth data line;

the sixth demultiplex module comprises: a sixteenth thin film transistor, and a gate of the sixteenth thin film transistor is electrically coupled to the first branch control signal, and a source is electrically coupled to a sixth data signal, and a drain is electrically coupled to a thirteenth data line; a seventeenth thin film transistor, and a gate of the seventeenth thin film transistor is electrically coupled to the second branch control signal, and a source is electrically coupled to the sixth data signal, and a drain is electrically coupled to a sixteenth data line; and an eighteenth thin film transistor, and a gate of the eighteenth thin film transistor is electrically coupled to the third branch control signal, and a source is electrically coupled to a sixth data signal, and a drain is electrically coupled to an eighteenth data line;

the seventh demultiplex module comprises: a nineteenth thin film transistor, and a gate of the nineteenth thin film transistor is electrically coupled to the first branch control signal, and a source is electrically coupled to a seventh data signal, and a drain is electrically coupled to a twelfth data line; a twentieth thin film transistor, and a gate of the twentieth thin film transistor is electrically coupled to the second branch control signal, and a source is electrically coupled to the seventh data signal, and a drain is electrically coupled to a twenty-second data line; and an twenty-first thin film transistor, and a gate of the twenty-first thin film transistor is electrically coupled to the third branch control signal, and a source is electrically coupled to a seventh data signal, and a drain is electrically coupled to a twenty-third data line;

the eighth demultiplex module comprises: a twenty-second thin film transistor, and a gate of the twenty-second thin film transistor is electrically coupled to the first branch control signal, and a source is electrically coupled to an eighth data signal, and a drain is electrically coupled to a nineteenth data line; a twenty-third thin film transistor, and a gate of the twenty-third thin film transistor is electrically coupled to the second branch control signal, and a source is electrically coupled to the eighth data signal, and a drain is electrically coupled to a twenty-first data line; and an twenty-fourth thin film transistor, and a gate of the twenty-fourth thin film transistor is electrically coupled to the third branch control signal, and a source is electrically coupled to an eighth data signal, and a drain is electrically coupled to a twenty-fourth data line;

polarities of two adjacent data signals are opposite;

wherein all the first, third, fifth and seventh data signals have a positive polarity, and all the second, fourth, sixth and eighth data signals have a negative polarity; and wherein polarities of the sub pixels of the first to third columns respectively are: positive, negative, negative; polarities of the sub pixels of the fourth to sixth columns respectively are: positive, negative, positive; polarities of the sub pixels of the seventh to ninth columns respectively are: positive, negative, positive; polarities of the sub pixels of the tenth to twelfth columns respectively are: negative, negative, positive; polarities of the sub pixels of the thirteenth to fifteenth columns respectively are: negative, positive, positive; polarities of the sub pixels of the sixteenth to eighteenth columns respectively are: negative, positive, negative; polarities of the sub pixels of the nineteenth to twenty-first columns respectively are: negative, positive, negative; polarities of the sub pixels of the twenty-second to twenty-fourth columns respectively are: positive, positive, negative.

13. The demultiplex type display driving circuit according to claim 12, wherein the scan line receives a scan signal.

14. The demultiplex type display driving circuit according to claim 13, wherein pulse durations of the first, second and third branch control signals are ⅓ of a pulse duration of the scan signal.

15. The demultiplex type display driving circuit according to claim 14, wherein in a pulse duration of one scan signal, a rising edge of the first branch control signal and a rising edge of the scan signal are generated at the same time, and a rising edge of the second branch control signal and a falling edge of the first branch control signal are generated at the same time, and a rising edge of the third branch control signal and a falling edge of the second branch control signal are generated at the same time, and a falling edge of the third branch control signal and a falling edge of the scan signal are generated at the same time.

* * * * *